US005746541A

United States Patent [19]

Brophy et al.

[11] Patent Number: 5,746,541

[45] Date of Patent: May 5, 1998

[54] ELECTRONIC DOG FENCE INSTALLER

[75] Inventors: Robert C. Brophy, Raymond; Eldon W. Wooters, Lincoln; R. Scott Capps, Clatonia, all of Nebr.

[73] Assignee: Tuefco Manufacturing, Incorporated, Minneapolis, Minn.

[21] Appl. No.: 652,957

[22] Filed: May 24, 1996

[51] Int. Cl.[6] ..... E02F 5/10

[52] U.S. Cl. ..... 405/174; 405/177; 405/183

[58] Field of Search ..... 405/174–180, 405/183

[56] References Cited

U.S. PATENT DOCUMENTS

| | | | |
|---|---|---|---|
| Re. 26,718 | 11/1969 | Kelley | 405/180 |
| 2,812,731 | 11/1957 | Gardner | 405/183 |
| 3,066,491 | 12/1962 | Ryan | 405/177 |
| 3,647,003 | 3/1972 | Gagne | 172/40 |
| 3,659,426 | 5/1972 | Caldwell | 405/183 |
| 3,757,529 | 9/1973 | Kaercher, Jr. | 405/176 |
| 3,788,575 | 1/1974 | Boettcher et al. | 242/390.6 |
| 4,079,593 | 3/1978 | Flippin | 405/182 |
| 4,896,997 | 1/1990 | Gaylin | 405/156 |

FOREIGN PATENT DOCUMENTS

7772III 5/1956 Germany .

*Primary Examiner*—Tamara L. Graysay
*Assistant Examiner*—Tara L. Mayo
*Attorney, Agent, or Firm*—Peterson, Wicks, Nemer & Kamrath, P.A.

[57] ABSTRACT

A mobile sod cutting machine has mounting arms that have a central axis of elongation with a cable installer mechanism mounted to the lower end of one of the arms for being reciprocated with the arm. The cable installer mechanism includes a vertical ground slitting blade having a front slitting edge, a bottom edge intersecting the slitting edge and a shank mounting portion mounted to the mounting arm. An upper cable guide is attached to the shank mounting portion to extend rearwardly of the central axis of elongation of the mounting arm while a bottom cable guide is mounted to the blade adjacent to the intersection of the blade bottom edge and slitting edge to have its reversely bent edge forwardly of the central axis of elongation but spaced rearwardly of the blade bottom edge along the guide length by a distance about as least as great as the reciprocal fore and aft movement of the blade. A supply of flexible cable is mounted to the machine to extend through the cable guides and be buried as the blade moves forwardly in the ground.

20 Claims, 2 Drawing Sheets

ELECTRONIC DOG FENCE INSTALLER

FIELD OF THE INVENTION

This invention relates to apparatus for installing a cable underground and more particularly for installing an electric dog fence.

DESCRIPTION OF THE PRIOR ART

Electric dog fences are provided where an electric cable is buried under the ground a short distance and the dog wears a collar which gives an electric shock if the dog approaches the area of the electric cable.

It is old to provide a machine having a plow for making a slit trench and to feed a flexible cable into the slit trench as the machine moves forwardly. With some prior art cable installing machines, the plow is moved horizontally forwardly without any intentionally imparted vibratory or oscillatory movement being imparted to the plow. However, a greater forward moving force is required than with other types of cable installing machines. With some other types of such machines, vibratory or orbital movement is imparted to the plow or blade as the plow is moved forwardly.

In order to overcome problems with prior cable installers for installing cable underground, for example electric cable for dog fences, this invention has been made.

SUMMARY OF THE INVENTION

The cable installer includes a mobile machine having ground engaging wheels, for example a conventional sod cutting machine, together with a mounting arm, a mechanism mounted to the machine frame for holding a spool of cable and a ground slitting blade for cutting a slit trench in the ground into which the cable is fed. Advantageously, the mobile machine is a sod cutting machine of a conventional self propelled type with a mechanism for reciprocating (oscillating) its mounting arm(s) and thereby the slitting blade attached to one of the arms. The slitting blade is of a solid plate type having a ground slitting (cutting) blade edge, an upper cable guide being joined to the upper shank portion of the blade while an elongated bottom, reversely bent guide is joined to the lower portion of the blade to extend rearwardly thereof. The length of the bottom guide legs that extend generally horizontally rearwardly of the slitting blade is greater than the fore and aft horizontal movement of the blade during one cycle of oscillatory movement of the blade while cutting a slit trench.

One of the objects of this invention is to provide new and novel means for guiding a cable into a slit trench as the trench is being cut. Another object of this invention is to provide new and novel means for guiding a cable into a slit trench during the trenching operation. A further object of this invention is to provide new and novel means for minimizing the flexing of a cable as the cable is being guided into a slit trench that is being formed by an oscillating or reciprocating blade or plow.

DETAILED DESCRIPTION

Figure 1:
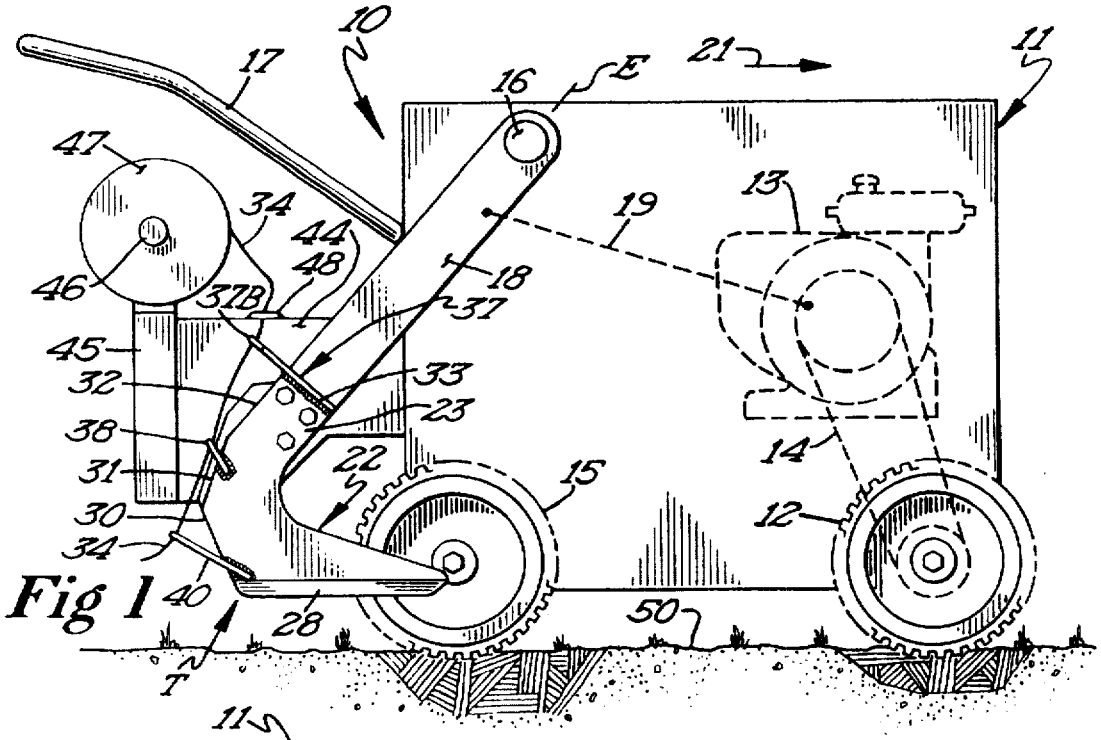
FIG. 1 is a somewhat diagrammatic side view of a self propelled sod cutting machine having the underground cable installer mechanism mounted thereon with the cable installer mechanism being shown in a datum position.
Figure 2:
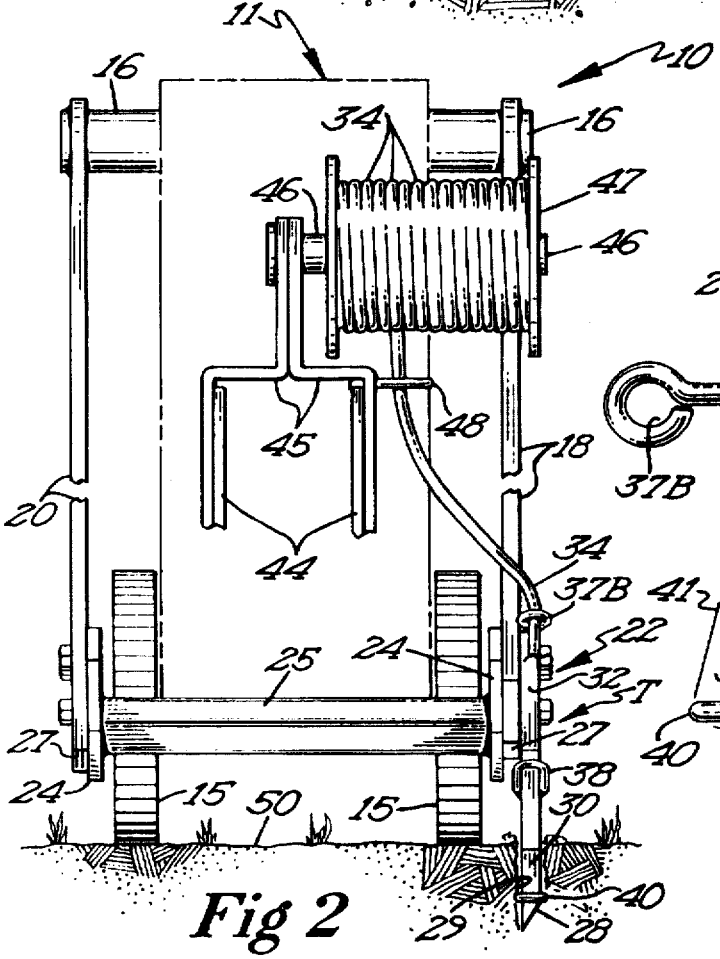
FIG. 2 is a fragmentary, somewhat diagrammatic rear view of the structure of FIG. 1 with the cable installer mechanism being in a cable installing position and with a vertical intermediate portion broken away.
Figure 5:
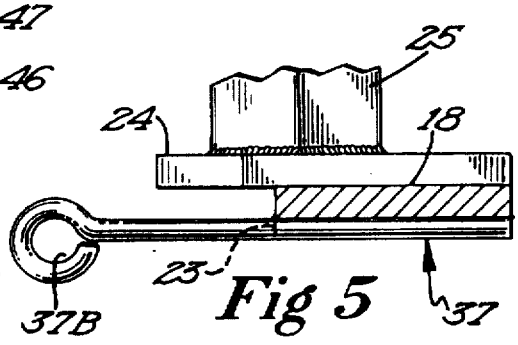
FIG. 5 is a top view of the blade upper cable guide, the mounting arm to which the blade is attached and a fragmentary portion of the cross brace which extends between the mounting arms, said view being generally taken along the line and in the direction of the arrows 5—5 of FIG. 3.

Referring in particular to FIGS. 1 and 2, the self propelled, conventional sod cutting machine, generally designated 10, which is somewhat diagrammatically illustrated, includes a frame 11 that is mounted for movement in a longitudinal forward direction (arrow 21) by front wheels 12 and rear wheels 15. A motor or engine 13 is mounted to the frame and is drivingly connected through a conventional drive connection 14 to one set of wheels, for example the front wheels. A control handle 17 is connected to the frame for controlling the direction of movement of the machine.

Elongated mounting arms 18 and 20, which are of the same lengths, have their upper ends mounted to the frame 11 for movement in a conventional manner between a datum position and a generally vertical extending trench slitting position by a suitable arm mount(s) 16. A suitable drive connection 19 is connected between the engine and at least one of the arms 18 and 20 and/or the arm mounts 16 for reciprocating (oscillating) the mounting arms 18 and 20 in a conventional manner. The arms are parallel to one another and have their lower ends extending downwardly adjacent to or below the plane of the axes of rotation of the front and rear wheels when the arms are in their trench slitting position such as in part shown in FIG. 3 to cut the trench 29 in the ground.

For installing a cable underground, the cable installer mechanism T is mounted to the machine 10. The installer mechanism includes a transverse cross brace 25 extending between the lower ends of the mounting arms 18 and 20, a bracket 24 being secured to the opposite ends of the brace. One of the brackets is, bolted to the mounting arm 20 while the other bracket in conjunction with the shank portion 23 of the cutting blade, generally designated 22, is bolted to the mounting arm 18 (see FIG. 2). A spacer bar 27 is bolted to each bracket 24 to abut against or be closely adjacent to the edge of the respective mounting arm that is radially remote from the arm mounts 16.

Figure 3:
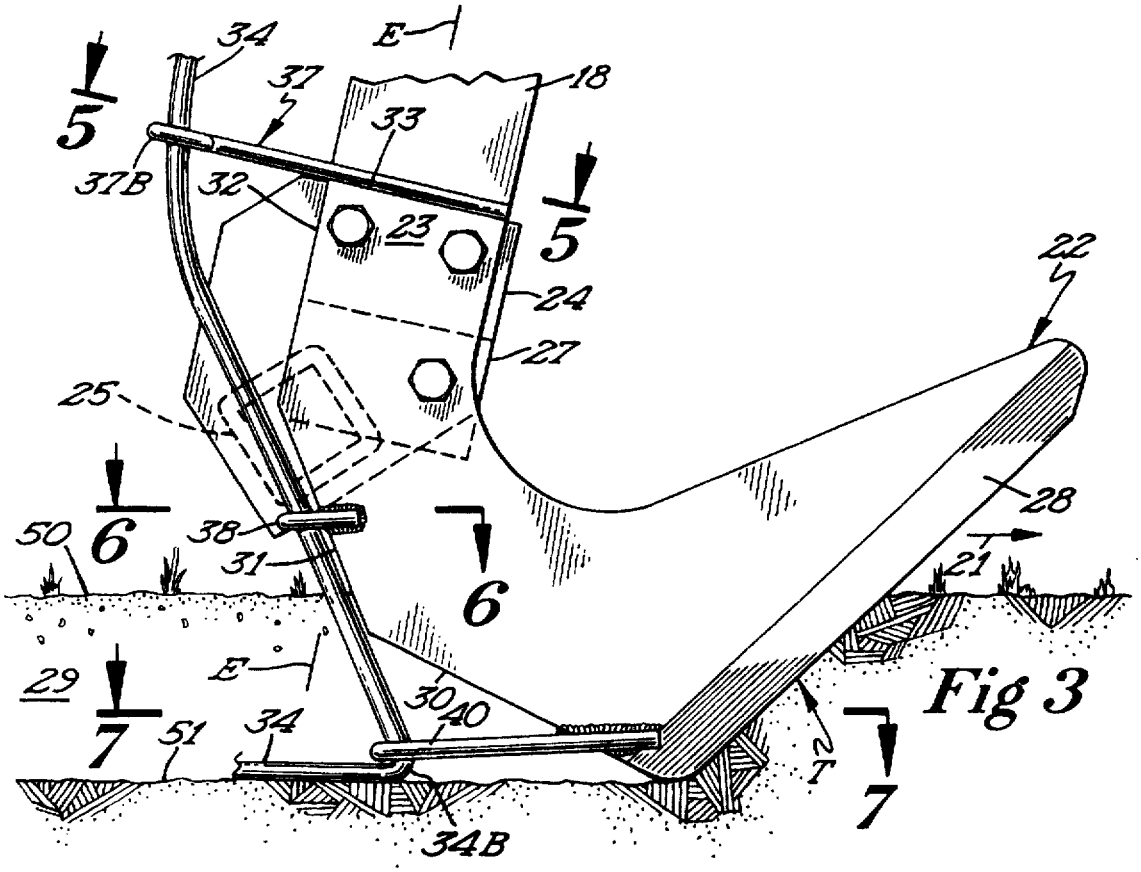
FIG. 3 is an enlarged side view of the ground slitting blade forming a slit trench in the ground together with cable guide members mounted to the blade.
Figure 6:
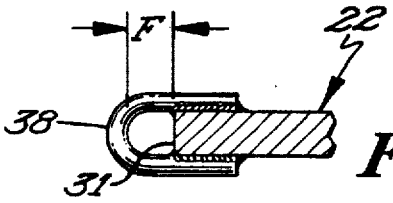
FIG. 6 is a plan view of the blade cable intermediate guide member that is generally taken along the line and in the direction of the arrows 6—6 of FIG. 3.
Figure 7:
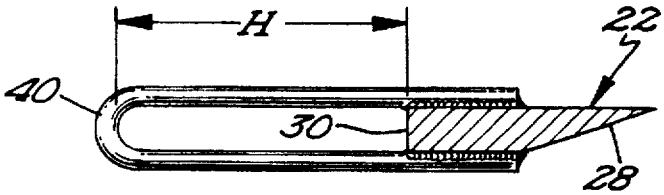
FIG. 7 is a plan view of the blade bottom cable guide that is generally taken along the line and in the direction of the arrows 7—7 of FIG. 3.

The cutting blade 22 advantageously is of a generally flat solid plate construction, other than for the sharpened ground slitting (cutting) edge 28, which in the blade trench slitting position of FIG. 3, extends diagonally upwardly in a forward direction from the blade bottom edge 30 with which it intersects. The blade bottom edge intersects with the sharpened edge 28 at an obtuse included angle. When the mounting arms central axis of extension elongation E—E of the mounting arm 18 extends perpendicular to the horizontal, the bottom edge 30 extends upwardly and rearwardly at an acute angle that is less than 45 degrees.

From the bottom edge 30, the blade has a diagonal edge portion 31 extending upwardly in a rearward direction to intersect with the blade shank portion rear edge 32. The edges 30, 31 intersect at an obtuse included angle. The blade shank portion has the rear edge 32, which may be of a straight line shape and a top edge 33, which in the blade trench slitting position, is a substantial distance horizontally rearwardly of the sharpened edge 28.

For purposes of describing the blade cable guides, it will be assumed the blade is in its trench slitting position of FIG. 3. A blade upper cable guide 37 has an elongated rod portion joined to the blade top edge 33 to extend rearwardly and has a rear eye portion 37B a substantial distance rearwardly of the central axis of elongation E—E of the mounting arms and the rear edge 32 of the blade shank. The eye portion aperture diameter is larger than the diameter of the flexible cable 34 to be buried.

An elongated blade intermediate cable guide 38, which advantageously is U-shaped in plan view, has the front end portions of its legs extending along opposite sides of the blade and joined to the opposite vertical surface portions of the blade vertically intermediate the blade upper cable guide 37 and the intersection of the sharpened edge 28 and the blade bottom 30, for example, about 40%–60% of the vertical distance between the guide 37 and the intersection of bottom 30 with the sharpened edge portion 28. The web (reversely bent portion) of the guide 38 is located horizontally rearwardly of the blade edge 31 by a distance F along the length of the guide legs to provide a predominately horizontally extending loop portion. Advantageously the distance F is at least two or three times greater than the diameter of the cable 34. That is, the length of the legs between the reversely curved portion of the guide 38 and the generally horizontal adjacent part (most closely adjacent part) of the blade is indicated by the dimension F. However, advantageously the web of the intermediate guide 38 is located entirely forwardly of a straight line extension of shank edge 32.

An elongated blade bottom cable guide 40, which advantageously may be U-shaped in plan view, has the front end portions of its legs extending along opposite sides of the blade and joined to opposite vertical surface portions of the blade adjacent to the intersection of the sharpened edge 28 and the blade bottom edge 30 to extend rearwardly of the sharpened edge. When the mounting arm is in its trench slitting position, the bottom cable guide extends predominantly horizontally. The web (reversely bent portion) of the guide 40 is spaced from blade bottom edge 30 by a distance H along the length of the guide legs. Accordingly, the bottom cable guide 40 provides a generally horizontal loop that opens vertically upwardly and downwardly when the mounting arm 18 is in its trench slitting position. The dimension H is many times greater, advantageously at least two or three times greater, than the dimension F. Also, the dimension H is greater than the horizontal movement of the portion of the blade to which the guide 40 is attached during one cycle of reciprocal movement of the blade. Further, advantageously the rearwardmost part of the web of the bottom guide is located such that along the length of the legs, the minimum spacing from a straight line extension of shank edge 32 is greater than the minimum spacing of the intersection of blade edges 30 and 31 from the straight line extension of shank edge 32. Additionally, the minimum spacing of the blade bottom guide from the shank top edge 33 is greater than that of the intersection of blade edges 30 and 31 from edge 33, which in turn is greater than the minimum spacing of the intermediate guide 38 from the shank top edge.

Figure 4:
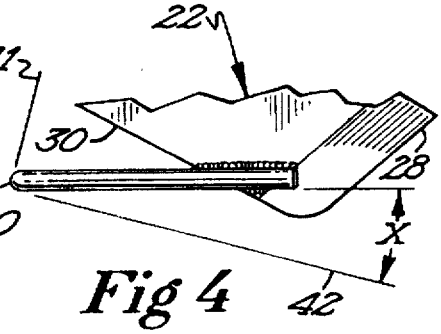
FIG. 4 is a diagrammatic view of the angle of extension of the blade bottom guide relative to the blade.

Advantageously the blade shank rear edge 32 is parallel to the central axis of elongation E—E of the mounting arms 18 and 20 and perpendicular to the top edge 33 and the rod portion of the blade upper cable guide 37. Further, the blade intermediate and bottom guides extend parallel to one another, but diverge from the blade upper guide in a rearward direction. For example, as indicated in FIGS. 3 and 4, the blade bottom guide extends forwardly and upwardly at an acute angle X relative to line 42. The line 42 extends at right angles to the line 41, which in turn is parallel to shank edge 32. The angle X may be about 10 to 20 degrees. When the mounting arms are in their trench slitting position, each of the blade guides extends predominantly horizontally rearwardly of the blade in each of the blade fore and aft reciprocated positions relative to the frame and the positions intermediate the fore and aft positions.

Advantageously, the web portion of the bottom guide 40 is located forwardly of each of the straight line extension of rear edge 32 and the central axis of elongation E—E while the web portion of the guide 38 is located rearwardly of the central axis of elongation, but forwardly of the straight line extension of rear edge 32. Further, each of the intersection of edges 30 and 31 and the web portion of intermediate guide 38 are located forwardly of a straight line extension of edge 32 while said intersection is forwardly of the central axis E—E.

For supporting a supply of cable, the frame 11 has rearwardly extending frame portions 44, a bracket 45 being suitably removably attached to the frame portions 44 to extend there-above. The upper portion of the bracket mounts a spool mounting stud 46 for having a spool 47 with wound cable thereon. An eyelet guide 48 is mounted to the bracket 45 at a lower elevation than the stud for having the cable extend downwardly from the reel, then downwardly through the guide 48, next sequentially downwardly through the cable guides 37 and 38, and then through the blade bottom guide to extend rearwardly thereof.

With the cable extended downwardly through the cable guides as set forth in the preceding paragraph, the free end of the cable fixed to the ground and the slitting blade in its trenching position, as the sod cutting machine moves forwardly with the slitting blade being reciprocated, during the forward motion part of the reciprocating cycle, the web of the bottom guide acting against the cable results in additional cable being paid out in the slit trench formed in the ground by the slitting blade. However, during the aft movement part of the cycle, the web of the bottom guide moves away from the adjacent vertically extending part of the cable to minimize imparting flexing forces to the part of the cable that is adjacent to the bottom 51 of the trench 29. That is, as the blade is reciprocated rearwardly from its forward reciprocated position, the web of the bottom guide 40 moves rearwardly of the cable bent portion 34B. The spacing H of the web of guide 40 from the edge 30 is sufficiently great that even with the sod cutting machine moving forwardly, or even without the sod cutting machine moving forwardly, the blade bottom edge 30 does not contact the cable bent portion 34B during the aft movement part of the cycle of the reciprocal movement of the blade. Further, the flexing of the cable adjacent to the cable bent portion 34 is in part minimized due to the dimension F of the legs of the blade intermediate cable guide 38 being at least a few times greater than the diameter of the cable.

As a result of the dimension of elongation H of the bottom blade guide legs relative to the diameter of the flexible cable 34, there is provided a lost motion connection. This lost motion connection allows the blade to reciprocate without requiring the cable adjacent the cable bent portion 34B reciprocating with the blade.

During normal use, the blade shank portion remains above the surface of the ground while the blade intermediate cable guide 38 usually is also above ground level. The blade bottom guide is below the ground surface 50, but does not extend to a lower elevation than the bottom of the trench cut by the sharpened edge 28.

Advantageously, the thickness (transverse dimension) of the slitting blade is less than twice as great as the diameter of the cable being buried as is the corresponding dimension of the legs of the guides 38 and 40 intermediate the respective guide web and the cable. Also, due to the blade guides 37, 38, 40 being vertically spaced from one another and the diameter of the rod and leg portions of guides being about the same or less than the thickness of the blade, resistance to the forward movement of blade cable guides and the blade is minimized. That is, the generally vertical dimension of each of the legs in a plane perpendicular to its direction of elongation is advantageously the same or less than the maximum thickness of the blade. Further, advantageously the opposite side surfaces of the blade, other than for the sharpened cutting edge 28 are parallel to one another.

Since the bottom guide loop portion in cross section perpendicular to the elongation of the loop portion advantageously is of a vertical dimension about the same or less than the thickness of the blade, the generally vertical, transverse cross sectional dimension of each of the cable guides is relatively small as compared to the depth of the trench, and the movement of each of the bottom guide and the intermediate guide (if it at least in part moves below the surface of the ground during the trenching operation) together with the reciprocal movement of the cable guide(s) is predominantly horizontal as the blade cuts the trench, the frictional drag on the cable installer mechanism as the trench is being cut is substantially reduced. Additionally, with the blade edges 30 and 31 intersecting at an obtuse angle and the bottom blade guide being joined to the blade adjacent to the juncture of the sharpened edge 28 and edge 30 together with the web portion of the bottom guide being able to be and being located vertically downwardly of the intersection of the blade edges 30 and 31 and forwardly of the central axis of elongation E—E, the amount of material of the cable installer mechanism subjected to frictional drag as a trench is being slit and the cable is being guided adjacent to the bottom of the trench and paid out closely adjacent to the bottom of the trench is minimized.

With this invention, a sod cutting machine can be easily adapted for a new usage, namely for slitting trenches for burying electrical or other types of flexible cables. Accordingly, more extensive usage may be made of a sod cutting machine than otherwise would be possible.

Even though the invention has been described with reference to a sod cutting machine, it is to be understood the combination of the blade guides and the blade together with the spool of cable may be mounted on a different type of mobile machine as long as there is provided an arm for reciprocating or orbiting the blade to cut a slit trench. The vertical dimension of the blade in its trench slitting position would in part depend upon the depth below the ground surface that the cable is to be buried. This in part depends upon whether the flexible cable being buried is of a type to be used as an electric dog fence, or for other purposes. Also, depending upon the thickness of the blade, the diameter of the cable and the consistency of the soil, one may or may not have to backfill a slit trench to bury the paid out cable in the bottom of the slit trench.

What is claimed is:

1. Mechanism for cutting a slit trench in the ground and paying out cable when moved in a forward direction in the ground for burying cable and adapted for attachment to a mobile machine, comprising a vertical cutting blade having a front ground slitting edge and an upper shank mounting portion, said shank mounting portion having a rear edge and a upper edge, the blade having a bottom edge portion intersecting the ground slitting edge, with the bottom edge portion in a vertical direction being at a substantially lower elevation than the shank portion, a first cable guide for having the cable movably extended therethrough and moving the cable forwardly therewith, the first guide being mounted to the shank portion to extend rearwardly thereof, and a second cable guide for having the cable extended therethrough, the second cable guide being mounted to the blade vertically downwardly of the first cable guide in substantial vertical spaced relationship to the first cable guide, the second cable guide including elongated legs that are generally horizontally elongated in a direction extending rearwardly of the blade slitting edge and a reversely bent web portion joined to the legs at a substantial distance along the length of the legs from the blade bottom edge for having the cable extend from the first guide, thence between the web portion and the blade and then rearwardly of the web portion to pay out the cable as the trench is being cut.

2. The mechanism of claim 1 wherein the blade has opposite, generally planar vertical surfaces and the legs have front end portions joined to the blade opposite surfaces, the spacing between the legs being substantially the same as the thickness of the blade between the opposite surfaces.

3. The mechanism of claim 1 wherein the vertical dimension of each of the legs, when the legs extend horizontally, is one of about the same or smaller than the thickness of the blade.

4. The mechanism of claim 1 wherein the blade has a diagonal edge extending between the bottom edge and the rear edge, the rear edge is a straight line edge, the legs are joined to the blade adjacent to the intersection of the slitting edge and the bottom edge, and the web portion is located generally horizontally between a straight line extension of the rear edge and the intersection of the slitting edge and the bottom edge.

5. The mechanism of claim 4 wherein a third blade cable guide is joined to the blade vertically intermediate the first and second blade cable guides in vertical spaced relationship to each of the first and second cable guides, the third cable guide having legs extending generally horizontally rearwardly relative to the blade and a reversely bent web joined to the third guide legs rearwardly spaced along the third guide legs from the blade diagonal edge, the spacing of the second guide web portion from the blade along the length of the second guide legs being many times greater than the spacing of the third guide web along the length of the third guide legs from the blade.

6. The mechanism of claim 5 wherein the web portion of the third cable guide is located further forwardly of a straight line extension of the rear edge than the web portion of the second cable guide and the first cable guide has a cable aperture that is located rearwardly of the rear edge.

7. A mobile machine in combination with a cable installer mechanism for cutting an elongated slit trench in the ground and installing a cable in the trench in the ground when moving in a longitudinal forward direction, the mobile machine including a frame, ground engaging wheels mounted to the frame, an engine mounted to the frame, a vertically elongated mounting arm movable between a datum position and a trench slitting position, said mounting arm having an upper end and a lower end, means for mounting the upper end of the mounting arm to the frame for movement relative to the frame, and means connected between the engine and one of the arm mounting means and the mounting arm for reciprocating the arm lower end between fore and aft positions relative to the frame when the mounting arm is in its trench slitting position, and the cable installer mechanism including cable supply means for paying out cable, mounting means for mounting the cable supply means to the frame, a vertical cutting blade for cutting a slit trench in the ground, said blade having a front ground slitting edge and an upper shank mounting portion mounted to the mounting arm lower end portion for being reciprocated with the mounting arm, said shank mounting portion having a rear edge, the blade having a bottom edge portion intersecting the ground slitting edge in a vertical spaced relationship to the shank portion, an upper cable guide for having the cable extend downwardly from the cable supply means and therethrough, the upper cable guide being mounted to the blade to extend generally horizontally rearwardly of the blade when the mounting arm is in its trench slitting position, and a bottom cable guide mounted to the blade to extend generally horizontally rearwardly thereof when the mounting arm is in its trench slitting position, the bottom cable guide having horizontally elongated, rearwardly extending legs and a reversely bent portion for having the cable extend between the legs and the reversely bent potion and the blade and then bent to extend rearwardly of the reversely bent portion, the dimension that the legs extend rearwardly of the blade being nearly at least as great as the reciprocal movement of the blade when the mounting arm is moved between its fore and aft positions.

8. The combination of claim 7 wherein the mobile machine is a sod cutting machine.

9. The combination of claim 7 wherein the mobile machine includes a second vertically elongated mounting arm movable between a datum position and a trench slitting position, said second mounting arm having an upper end and a lower end, means for mounting the upper end of the second mounting arm to the frame for movement relative to the frame, and the cable installer mechanism includes a transverse brace mounted to and extending between the lower ends of the arms.

10. The combination of claim 7 wherein the cable installer mechanism upper blade guide has an eye portion that includes an aperture through which the cable extends and means for mounting the eyelet portion spaced from and rearwardly of the blade and an intermediate blade guide is mounted to the blade to extend generally horizontally rearwardly of the blade when the mounting arm is in the trench slitting position, the intermediate cable guide being vertically intermediate the upper and bottom cable guides and vertically spaced therefrom.

11. The combination of claim 10 wherein the blade intermediate guide has a reversely bent portion opening toward the blade and legs joined to the last mentioned reversely bent portion and extending to the blade, with the spacing of the reversely bent portion of the intermediate cable guide along the length of its legs from the blade being many times less than the spacing of the reversely bent portion of the bottom guide from the blade along the length of the legs of the bottom guide.

12. The combination of claim 11 wherein the mounting arm has a central axis of elongation, the blade ground slitting edge extends upwardly and forward when the mounting arm is in its trench slitting position, the blade bottom edge portion intersects the slitting edge and is inclined upwardly and rearwardly from the slitting edge and the blade has an intermediate edge extending between the bottom edge portion and the shank portion, the bottom guide legs being joined to the blade adjacent to the intersection of the ground slitting edge and the bottom edge portion and the bottom guide reversely bent portion being forwardly of an extension of the central axis of elongation.

13. A mobile machine in combination with a cable installer mechanism for cutting an elongated slit trench in the ground and installing a cable in the trench in the ground when moving in a longitudinal forward direction, the mobile machine including a frame, ground engaging wheels mounted to the frame, an engine mounted to the frame, a vertically elongated mounting arm movable between a datum position and a trench slitting position, said mounting arm having a central axis of elongation, an upper end and a lower end, means for mounting the upper end of the mounting arm to the frame for movement relative to the frame, and means connected between the engine and one of the arm mounting means and the mounting arm for reciprocating the arm lower end between fore and aft positions relative to the frame when the mounting arm is in its trench slitting position, and the cable installer mechanism including cable supply means for paying out cable, mounting means for mounting the cable supply means to the frame, a vertical slitting blade for cutting a slit trench in the ground, said blade having a ground slitting edge forwardly of the central axis of elongation and an upper shank mounting portion mounted to the mounting arm lower end portion for being reciprocated with the mounting arm, an upper cable guide for having the cable extend downwardly from the cable supply means and therethrough, the upper cable guide being mounted to the blade to extend generally horizontally rearwardly of the blade when the mounting arm is in its trench slitting position, and a bottom cable guide mounted to the blade to extend generally horizontally rearwardly thereof when the mounting arm is in its trench slitting position, the bottom cable guide having horizontally elongated, rearwardly extending legs and a reversely bent portion for having the cable extend between the legs and the reversely bent portion and the blade, the reversely bent portion being forwardly of the central axis of elongation.

14. The combination of claim 13 wherein an intermediate cable guide is mounted to the blade vertically intermediate the upper cable guide and the bottom cable guide, the intermediate cable guide having a reversely bent portion that is rearwardly of the central axis of elongation and opening toward the blade.

15. The combination of claim 13 wherein the dimension that the bottom guide legs extend rearwardly of the blade bottom edge portion along the length of the bottom guide legs is at least as nearly as great as the movement of the blade between fore and aft position of the mounting arm.

16. The combination of claim 13 wherein the blade further includes a bottom edge portion intersecting the ground splitting edge in a vertical spaced relationship to the shank portion.

17. Cable installer mechanism mountable to a mobile machine which is movable in a forward direction and has an elongated mounting arm with a lower end reciprocable in a fore and aft direction when in a trench slitting position and has a central axis of elongation and a mounting device for supporting a supply of flexible cable, comprising, in combination: a vertical cutting blade for cutting a slit trench in the ground, said blade having a ground slitting edge, and an upper shank portion mountable to the mounting arm lower end for being reciprocated fore and aft therewith, an upper cable guide for having flexible cable extend therethrough, the upper cable guide being joined to the blade to extend generally horizontal rearwardly of the blade, and an elongated bottom cable guide mounted to the blade to extend rearwardly of the blade slitting edge, the bottom cable guide having a predominately horizontally extending, elongated loop rearwardly of the juncture of the bottom cable guide to the blade, said loop having a vertical loop opening that extends in a predominantly horizontal plane for having the cable extend from the upper cable guide, then vertically through the loop opening and thence bent around the loop to extend horizontally rearwardly of the bottom cable guide.

18. The cable installer mechanism of claim 17 wherein the loop includes a reversely bent web portion that opens toward the blade and is forwardly of the central axis when the shank portion is mounted to the mounting arm, the loop opening extending generally horizontally from the reversely bent portion to the blade.

19. The cable installer mechanism of claim 17 wherein the bottom guide loop in cross section perpendicular to the elongation of the loop is of a vertical dimension about the same or less than the thickness of the blade.

20. The cable installer mechanism of claim 17 wherein the blade further includes a bottom edge portion intersecting the ground splitting edge in a vertical spaced relationship to the shank portion.

* * * * *